US008847126B2

(12) United States Patent
Ishiguro et al.

(10) Patent No.: US 8,847,126 B2
(45) Date of Patent: Sep. 30, 2014

(54) HEATING DEVICE AND HEATING METHOD

(75) Inventors: Katsunori Ishiguro, Toyota (JP); Masaki Furuhashi, Toyota (JP); Martin Pohl, Altenbeken (DE); Kiyohito Kondo, Toyota (JP)

(73) Assignees: Aisin Takaoka Co., Ltd., Toyota-Shi, Aichi (JP); Benteler Automobiletechnik GmbH, Paderborn (DE)

( * ) Notice: Subject to any disclaimer, the term of this patent is extended or adjusted under 35 U.S.C. 154(b) by 420 days.

(21) Appl. No.: 13/057,941

(22) PCT Filed: Aug. 7, 2009

(86) PCT No.: PCT/JP2009/064008

§ 371 (c)(1),
(2), (4) Date: Feb. 7, 2011

(87) PCT Pub. No.: WO2010/016566

PCT Pub. Date: Feb. 11, 2010

(65) Prior Publication Data

US 2011/0132897 A1 Jun. 9, 2011

(30) Foreign Application Priority Data

Aug. 8, 2008 (JP) ..... 2008-206261

(51) Int. Cl.

| | |
|---|---|
| ***H05B 6/02*** | (2006.01) |
| ***C21D 1/09*** | (2006.01) |
| ***C21D 1/34*** | (2006.01) |
| ***C21D 9/46*** | (2006.01) |
| ***F27B 9/06*** | (2006.01) |
| ***F27B 9/24*** | (2006.01) |
| ***F27D 11/12*** | (2006.01) |

(52) U.S. Cl.

CPC .. *C21D 1/09* (2013.01); *C21D 1/34* (2013.01); *C21D 9/46* (2013.01); *F27B 9/063* (2013.01); *F27B 9/2407* (2013.01); *F27D 11/12* (2013.01); *C21D 2221/00* (2013.01)

USPC ..... 219/600

(58) Field of Classification Search

USPC ..... 219/388, 494, 497, 501, 506, 531, 523, 219/728–730; 392/423; 148/546, 643, 645

See application file for complete search history.

(56) References Cited

U.S. PATENT DOCUMENTS 3,730,785 A * 5/1973 Conrad ..... 148/607
5,536,337 A * 7/1996 Wei ..... 148/549

(Continued)

FOREIGN PATENT DOCUMENTS

DE 200 14 361 U1 10/2000
DE 101 62 415 A1 7/2003

(Continued)

OTHER PUBLICATIONS

Extended European Search Report dated Jun. 28, 2012, issued in corresponding European Patent Application No. 009805048.7-1215/2322672. (5 pages).

(Continued)

*Primary Examiner* — Dana Ross
*Assistant Examiner* — Renee L Miller
(74) *Attorney, Agent, or Firm* — Buchanan Ingersoll & Rooney PC

(57) ABSTRACT

A heating device and a heating method which is able to quickly and accurately partition each region of a material to be heated and heat up each of the region to a required temperature, and a shape and required temperature of each region is different from each other. A heating device for heating a material to be heated by applying an electromagnetic wave to the material, wherein a plate member(s) which shields, absorbs and/or reflects the irradiated electromagnetic radiation and has a predetermined pattern contour can be placed, at least partially, close to the material to be heated.

24 Claims, 8 Drawing Sheets

(56) References Cited

U.S. PATENT DOCUMENTS

| | | | | |
|---|---|---|---|---|
| 5,907,663 | A * | 5/1999 | Lee | 392/407 |
| 6,524,404 | B2 | 2/2003 | Gehringhoff et al. | |
| 6,667,111 | B2 * | 12/2003 | Sikka et al. | 428/547 |
| 6,891,138 | B2 * | 5/2005 | Dalton | 219/634 |
| 7,977,611 | B2 * | 7/2011 | DeMichael et al. | 219/553 |
| 2002/0104591 | A1 | 8/2002 | Gehringhoff et al. | |
| 2003/0094452 | A1 * | 5/2003 | Burkitbaev | 219/678 |
| 2005/0061808 | A1 * | 3/2005 | Cole et al. | 219/730 |
| 2009/0020523 | A1 | 1/2009 | DeMichael et al. | |

FOREIGN PATENT DOCUMENTS

| | | | |
|---|---|---|---|
| DE | 10 2006 054 389 | A1 | 5/2008 |
| EP | 2019149 | A1 | 1/2009 |
| JP | 61-149424 | A | 7/1986 |
| JP | 3-107414 | A | 5/1991 |
| JP | 5-45607 | A | 2/1993 |
| JP | 2001-44618 | A | 2/2001 |
| JP | 2002-241835 | A | 8/2002 |
| JP | 2007-314874 | A | 12/2007 |

OTHER PUBLICATIONS

Notification of Transmittal of Copies of Translation of the International Preliminary Report on Patentability (Form PCT/IB/338), International Preliminary Report of Patentability (Form PCT/IB/373), and Written Opinion of the International Searching Authority (Form PCT/ISA/237) dated Mar. 17, 2011, issued in corresponding International Patent Application No. PCT/JP2009/064008 by the International Bureau of WIPO.

International Search Report (PCT/ISA/210) issued on Nov. 17, 2009, by Japanese Patent Office as the International Searching Authority for International Application No. PCT/JP2009/064008.

Written Opinion (PCT/ISA/237) issued on Nov. 17, 2009, by Japanese Patent Office as the International Searching Authority for International Application No. PCT/JP2009/064008.

English-language translation of Notice of the Grounds for Rejections issued in Japanese Application No. 2008-206261.

* cited by examiner

HEATING DEVICE AND HEATING METHOD

REFERENCE TO RELATED APPLICATION

This application is based upon and claims the benefit of the priority of Japanese patent application No. 2008-206261 filed on Aug. 8, 2008, the disclosure of which is incorporated herein in its entirety by reference thereto.

TECHNICAL FIELD

The present invention relates to a heating device and a heating method.

BACKGROUND

A thin and high-strengthened material is used for parts of an automobile, for example, for satisfying both safety and economic purposes. A hot pressing (die quenching or hot forming) method, in which a heated steel plate is pressed by press-dies of low temperature and quenched, is known for a purpose of obtaining such a material. The method is practiced as follows. A steel plate is heated to the austenitizing temperature or more and then rapidly cooled by press-dies to quench the steel plate at the same time of its shape forming.

As a heating method for the hot pressing method, a method is known such as an electric (conduction) heating method or a method using a block heater, which can heat a material rapidly, as well as a furnace heating method. Patent Document 1 discloses a technique using a near infrared radiation heater as a heating furnace for hot pressing of parts of an automobile. Patent Documents 2 and 3 disclose a technique using infrared radiation for supplementary heating in a very small area of an electronic circuit part.

Patent Document 4 discloses a heating furnace for a work inside of which is divided into regions and each region can be heated at different temperature.

[Patent Document 1] Japanese Patent Kokai Publication No. JP2007-314874A

[Patent Document 2] Japanese Patent Kokai Publication No. JP-A-5-45607

[Patent Document 3] Japanese Patent Kokai Publication No. JP2001-44618A

[Patent Document 4] Japanese Patent Kokai Publication No. JP2002-241835A

SUMMARY

The entire disclosures of the above Patent Documents 1 to 4 are incorporated herein by reference thereto. The analysis on the related art is set forth below by the present invention.

On the other hand, there is a problem that a steel plate made by the hot pressing method becomes difficult to process than a steel plate before quenching because the steel plate made by the hot pressing method has a higher strength than that before quenching. As a result, needs for partial heat processing, by which a material is partially quenched or partially non-quenched, are increasing even for a hot pressing method for a purpose of optimizing property of product and processing steps. In that case, a portion to be partially heated should be partitioned in any desired shapes and in very small area according to a demand.

However, conventional furnaces or an electric heating cannot fulfill the needs, nor the heating furnace disclosed in Patent Document 1. As for partitioning of the furnace as described in Patent Document 4, it is difficult to partition in any desired shapes, and a gradual temperature-changing portion between a high temperature portion and a low temperature portion will become wide.

A near infrared radiation heating method is an alternative for rapid heating. The infrared radiation heating can set desired heating temperature of an infrared radiation lamp, and therefore it can heat a material to be heated partially and may change heating temperature partially.

However, according to knowledge of the present inventors, when heating a material partially by infrared radiation heaters, multiple heaters have to be arranged in a specified pattern and heating temperature of each heater has to be controlled separately. Even in that case, only linear partial heating was possible and it was difficult to control a position of a boundary of temperature definitely. In addition, a gradual temperature-changing portion between a high temperature portion and a low temperature portion was very wide and it was not possible to make the gradual temperature-changing portion as narrow as practical.

It is an object of the present invention to provide a heating device and a heating method which are able to quickly and accurately partition each region of a material to be heated and heat up each of the region to a required temperature, and a shape and required temperature of each region is different from each other. In addition, a gradual temperature-changing portion between the regions, that is, a portion that has a temperature gradient, can be made as small as practical by the device or method.

The object can be achieved by a heating device and a heating method that can heat a material to be heated by applying an electromagnetic wave to the material, wherein a plate member(s) which shields, absorbs and/or reflects the applied electromagnetic wave and has a predetermined pattern contour can be placed, at least partially, close to the material to be heated.

Steel materials such as a steel bar and a steel plate (steel sheet or steel product formed three-dimensionally) are typically selected as a material to be heated and non-iron materials, alloys, composite materials and the like are also included. Infrared radiation, microwave, laser and the like can be used as an electromagnetic wave for heating. Particularly, near infrared radiation can heat various kinds of metals rapidly. An insulator such as ceramics, asbestos and the like, reflecting mirror such as a gold-plating reflecting mirror and the like or reflecting materials may be used as a material to shield, absorb and/or reflect such electromagnetic radiations.

Another aspect of the present invention is a plate member(s) having predetermined patterned contour and used for any one of the heating device above explained, which shields, absorbs and/or reflect the electromagnetic wave for heating.

According to the present invention, it is possible to quickly and accurately partition each region of a material to be heated and heat up each of the region separately to a required temperature for each region, and a shape and required temperature of each of the region is different from each other, and a gradual temperature-changing portion between the regions, that is, a portion that has a temperature gradient, can be made as small as practical.

As for the explanation of symbols, please refer to the end of description.

PREFERRED MODES

Preferably, a plurality of generators of the electromagnetic radiation are arranged in the heating device of the present invention and a heating capacity of each of the generators can be controlled. By combining with a plate member such as a heat shielding plate, any region for high temperature heating portion or low temperature heating portion can be set.

Preferably, the generators of the electromagnetic radiation are arranged two- or three-dimensionally around the material to be heated and accordingly the plate member is placed two- or three-dimensionally between the generators and the material to be heated. A three-dimensional material to be heated can be also heated by the structure.

The generators may be near infrared generators and the plate member is made of material(s) which shield, absorb and/or reflect the irradiated near infrared radiation.

The plate member may be made of at least one of ceramics, fiber materials that can shield the irradiated radiation or a composite material thereof, and a reflecting mirror.

Preferably, the plate member is made of at least one component formed two- or three-dimensionally in conformity with a shape of a desired heating area of the material to be heated.

The material to be heated may be a steel plate or a steel plate product shaped three dimensionally. Particularly, a steel plate for parts of an automobile is preferably used.

The heating device may further include at least one radiation generator that is different from the generator of the electromagnetic wave.

The plate member may be supported by a stay bar and placed without contacting with a surface of the material to be heated. Or the plate member may be placed in contact with a surface of the material to be heated.

The generators may be one of middle-infrared generators, far-infrared generators, microwave generators and laser beam generators, and the plate member is made of material(s) which shield, absorb and/or reflect the irradiated electromagnetic radiation.

The whole of a steel material to be heated may be heated at a temperature lower than the austenitizing temperature and at the same time a predetermined area is heated at a temperature higher than the austenitizing temperature. It is possible, by the method, to shorten the heating time for the high temperature heating portion and also to increase shape retentivity of the product.

EXAMPLES

The present invention will be explained in detail with reference to drawings and exemplary examples. Before explaining the present invention, knowledge obtained by the inventors of the present invention will be explained for clarifying features of the present invention.

Figure 6A:
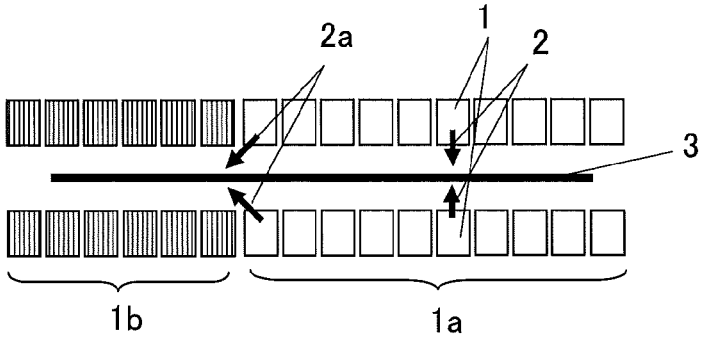
FIGS. 6A to 6D illustrate a sectional view and plan views showing a related art.
Figure 6B:
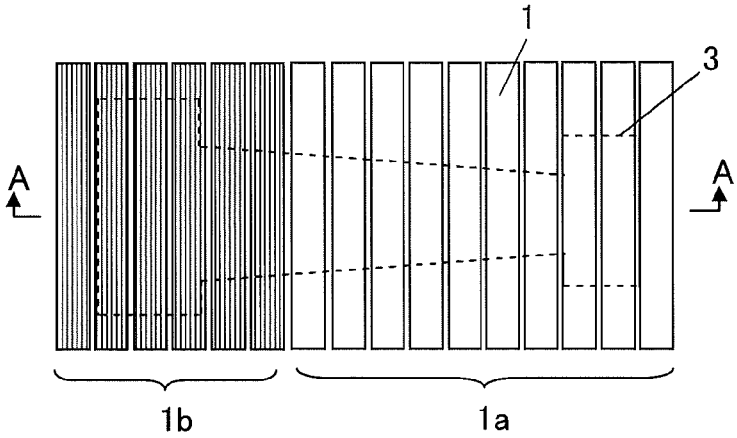

FIGS. 6A to 6D show an example of a related art by the inventors when heating a material to be heated (steel plate, in this example) partially. FIG. 6A is a sectional view taken along A-A line in FIG. 6B and FIG. 6B is a plan view. A material 3 to be heated is heated by infrared rays 2 irradiated by a plurality of near infrared lamps 1 arranged on both above and below the material to be heated. Heating temperatures of the near infrared lamps 1 can be controlled independently and by separating the heating temperature of the lamps for setting a high temperature heating portion 1*a* and for setting a low temperature heating portion 1*b*, the material 3 to be heated can be heated in different temperatures for a high temperature heating portion 5 and for a low temperature heating portion 6.

Figure 6C:
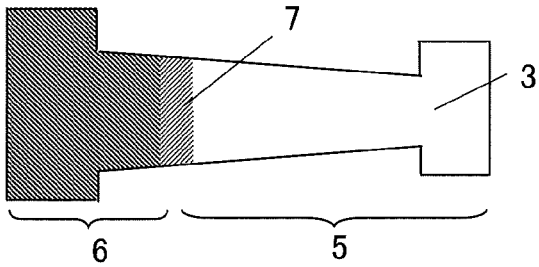
Figure 6D:
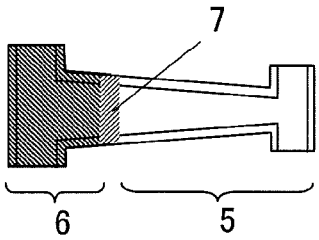

FIG. 6C shows a temperature distribution of the material to be heated. FIG. 6D is a hot-formed product made from the material to be heated by hot pressing. The high temperature heating portion 5 is formed into a high-strengthened portion 5 by quenching in the hot-forming step at the austenitizing temperature or more (about 800 degrees C. or more is preferable). The low temperature heating portion 6 is formed into a low-strengthened portion 6 due to non-quenching at a temperature lower than the austenitizing temperature (about 700 degrees C. or less is preferable). To optimize energy absorption capacity at a collision, it is necessary to set a position of the temperature boundary line, which is a strength boundary line, between the low-strengthened portion and the high-strengthened portion of the product accurately and make the gradual temperature-changing portion, which is a gradual strength-changing portion, as narrow as possible. However, high-temperature infrared ray 2*a* interfered with the low-temperature portion and the gradual temperature-changing portion 7 has generated in a wide area, and therefore it was not possible to set the boundary position between the high temperature region and the low temperature region accurately. In addition, the temperature boundary line could be set only in a straight line along the shape of the infrared lamp 1.

Figure 7A:
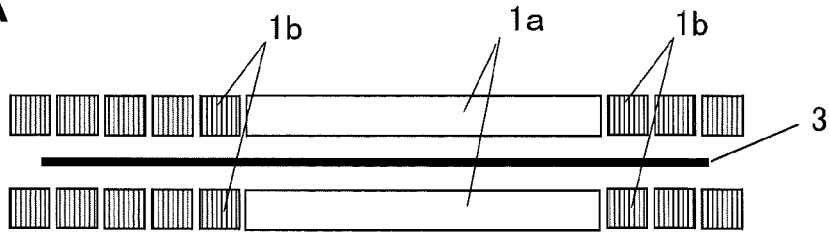
FIGS. 7A to 7C illustrate a sectional view and plan views showing a related art.
Figure 7B:
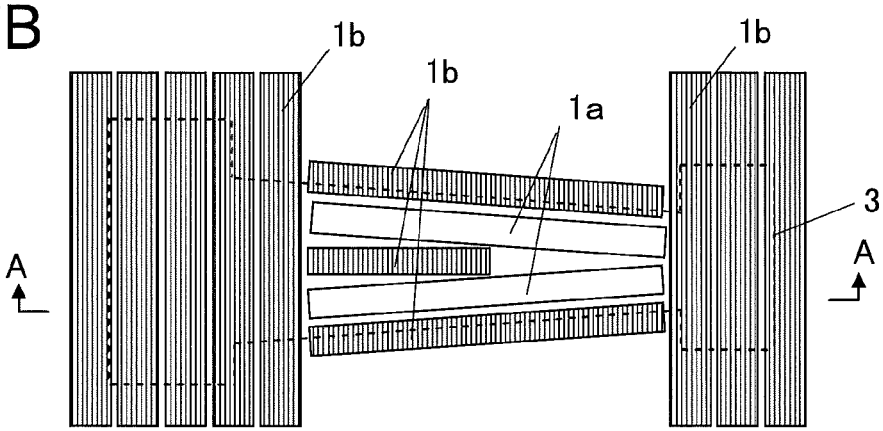
Figure 7C:
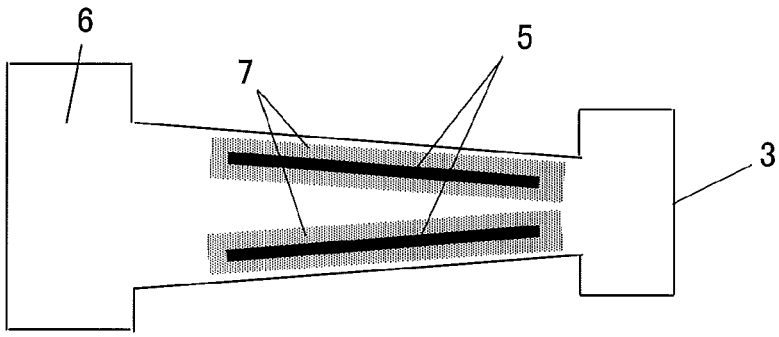
Figure 8A:
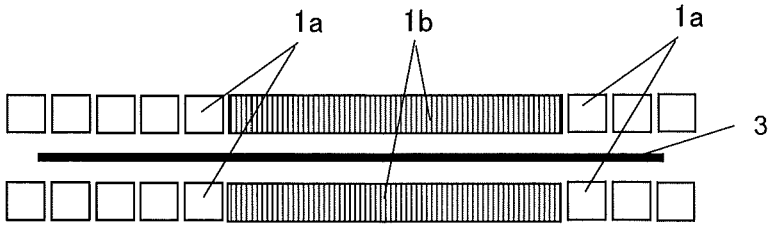
FIGS. 8A to 8C illustrate a sectional view and plan views showing a related art.
Figure 8B:
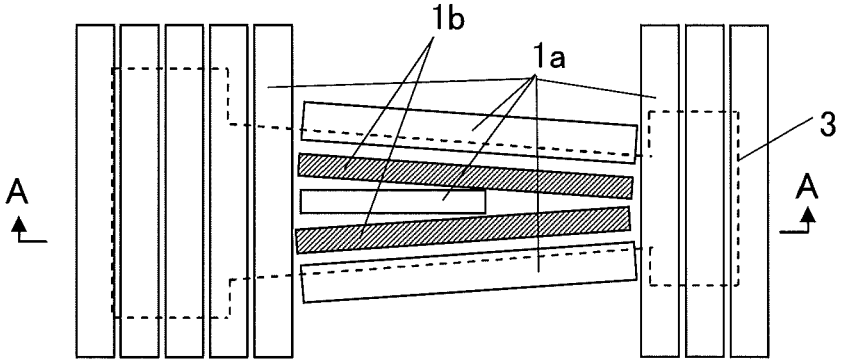
Figure 8C:
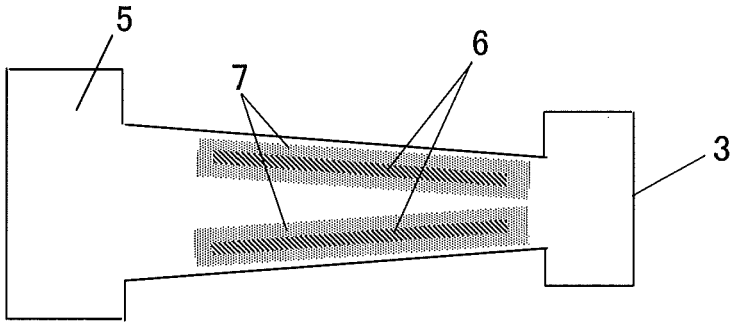

FIG. 7 illustrate a heating device and a heating method according to a related art for making a high temperature portion partially. A material 3 to be heated is heated by infrared lamps 1*a* for setting high temperature and infrared lamps 1*b* for setting low temperature arranged on both above and below. By arranging the infrared lamps 1*a* for setting high temperature along the partial portion 5 to be heated in high temperature, it is possible to set the high temperature heating portion 5 partially. However, the partial heating portion could be set only in a shape along the shape of the infrared lamp, the gradual temperature-changing portion 7 became large in terms of region as shown in FIG. 6 and the temperature boundary was not clear, FIG. 8 illustrate a heating method according to a related art for making a low temperature portion partially. A material to be heated 3 is heated by infrared lamps 1*a* and 1*b* arranged on both above and below the material. A low temperature heating portion 6 can be set partially by arranging the infrared lamps 1*b* for setting low temperature heating along a partial portion 6 to be heated in low temperature. However, the partial heating portion could be set only in a shape along the shape of the infrared lamp, the gradual temperature-changing portion 7 became large in terms of region as shown in FIG. 6 and the temperature boundary was not clear.

Example 1

Figure 1A:
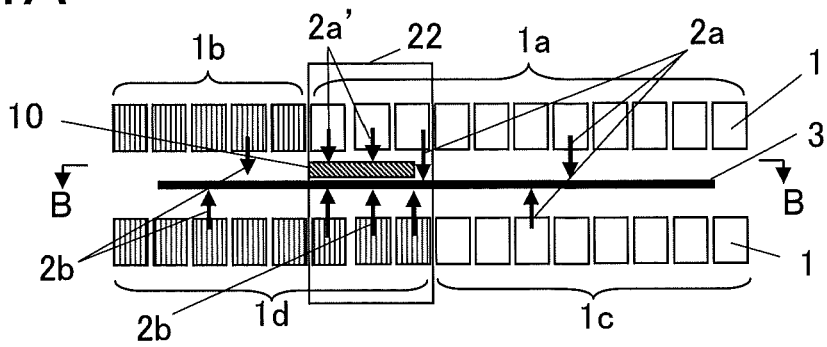
FIGS. 1A to 1C illustrate a sectional view and plan views of an example of a heating device according to the present invention.
Figure 1B:
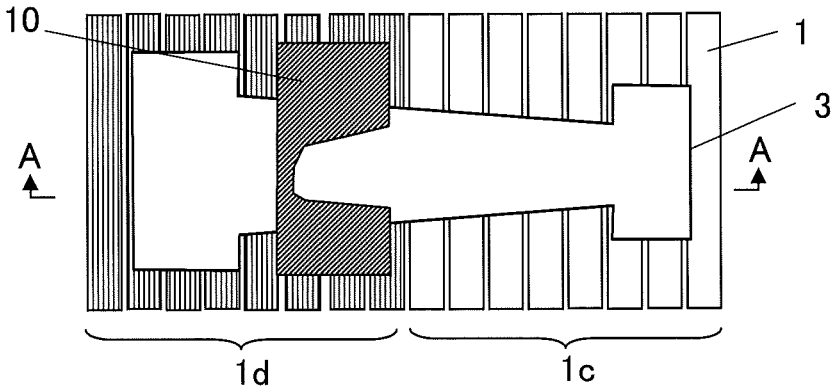
Figure 1C:
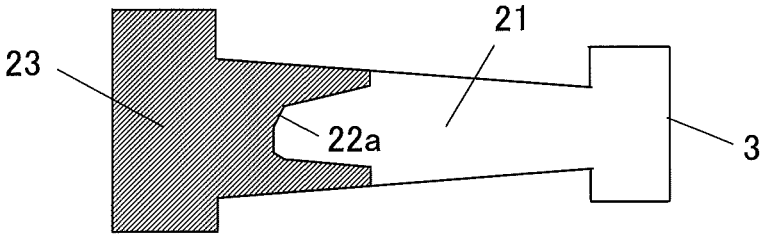

FIGS. 1A to 1C illustrate a sectional view and plan views of an example of a heating device according to the present invention. FIG. 1A is a sectional view taken along A-A of FIG. 1B and FIG. 1B is a plan view taken along B-B in FIG. 1A. Thus the near infrared lamps 1 disposed above are not shown in FIG. 1B. The material 3 to be heated is heated by near infrared ray 2 radiated by a plurality of near infrared lamps 1 arranged on both above and below the material 3. Heating capacity of the near infrared lamps can be controlled. As shown in FIG. 1A, the near infrared lamps 1 disposed above are divided into a high temperature setting portion 1*a* and a low temperature setting portion 1*b*, and the near infrared lamps 1 disposed below are divided into a high temperature setting portion 1*c* and a low temperature setting portion 1*d*. The material 3 to be heated is heated with a heat shielding plate 10 having a shape same as a required temperature boundary shape provided between the material 3 to be heated and the near infrared lamps 1 disposed above as shown in FIG. 1B.

As shown in FIG. 1A, in a temperature boundary region 22, the near infrared lamps disposed above are set as the high temperature setting portion 1*a* and the near infrared lamps disposed below are set as the low temperature setting portion 1*d*, and the whole surface of bottom side of the material 3 to be heated is heated with a low temperature infrared ray (infrared ray of low intensity) 2*b*. A top surface of the material 3 to be heated where the heat shielding plate 10 does not exist is heated by a high temperature infrared ray (infrared ray of high intensity) 2*a*. In a region of a top surface where the heat shielding plate 10 exists, the high temperature infrared ray 2*a*' is shielded by the heat shielding plate 10 and the ray does not reach the material 3 to be heated and the material is not heated into high temperature. However, the region is heated by the low temperature infrared ray 2*b* from below. Thus the material 3 to be heated is divided into a high temperature heating portion 21 and a low temperature heating portion 23 by a temperature boundary 22*a* having the same shape as the heat shielding plate 10, and the portion 21 is heated into high temperature and the portion 23 is heated into low temperature.

In the vicinity of the temperature boundary 22*a*, the high temperature infrared ray 2*a*' is shielded by the heat shielding plate 10 and therefore it does not interfere with the low temperature heating portion 23. Thus, the temperature boundary 22*a* can be positioned accurately and the gradual temperature-changing portion around the temperature boundary 22*a* can be made small enough. The fact that the temperature boundary 22*a* can be set in any shape means that a high-strengthened portion and a low-strengthened portion of a hot-formed product can be positioned freely according to functional requirements of the product, and it is advantageous for optimizing product performance and increasing of freedom of product design.

In this example, a portion where strength is given by a hot pressing is heated at high temperature up to the austenitizing temperature or more (approximately 800 degrees C. or more is preferable) and other portion is heated at the temperature lower than the austenitizing temperature by heating including from below. This contributes to shortening the heating time of the high temperature heating portion and to increasing shape retentivity of the material, that is, a spring back of the material to be heated after forming becomes small.

Figure 4A:
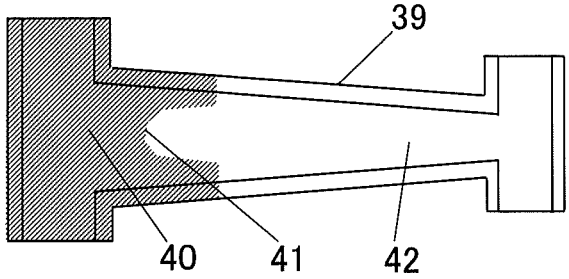
FIGS. 4A to 4C illustrate examples of product heated by the heating device according to FIGS. 1 to 3, FIGS. 5A and 5B illustrate an example of a structure of a heating device according to the present invention.

FIG. 4A shows an example of application of the present method to an automobile's part. When producing a product (B-pillar) 39 by hot forming, it is advantageous for increasing product characteristics, such as an improvement of energy absorption at a collision, to provide a portion 42 and a portion 40. The portion 42 is heated at high temperature up to the austenitizing temperature or more (about 800 degrees C. or more is preferable) and quenched so as to give high strength by the hot forming and the portion 40 is heated at a temperature lower than the austenitizing temperature (about 700 degrees C. or less is preferable) and not quenched so as to give high ductility. The temperature boundary 41 of the present invention can be set in any shape, which contributes optimization of product performance and increasing of freedom of product design. In addition, the product performance can be stabilized because the position of the temperature boundary 41 is accurate and the gradual temperature-changing portion becomes small.

Example 2

Figure 2A:
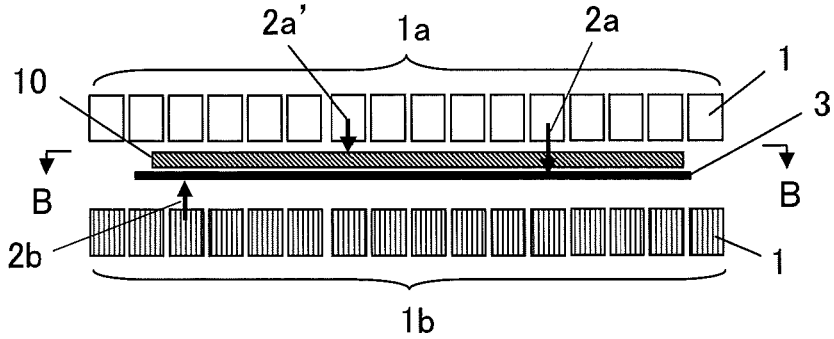
FIGS. 2A to 2C illustrate a sectional view and plan views of another example of a heating device according to the present invention.
Figure 2B:
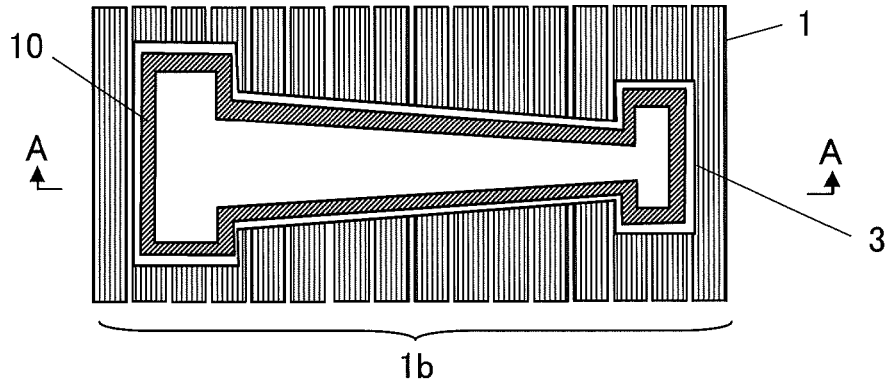
Figure 2C:
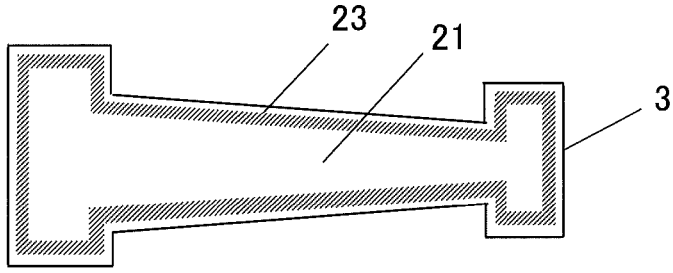

FIGS. 2A to 2C show another example of a heating device, and a low temperature partial heating method by the device, according to the present invention. FIG. 2A is a sectional view taken along A-A line in FIG. 2B and FIG. 2B is a plan view from B-B line of FIG. 2A. The basic concept is the same as Example 1. A material 3 to be heated is heated by infrared lamps 1 arranged on both above and below the material. The near infrared lamps 1*a* disposed above are set for high temperature heating and the near infrared lamps 1*b* disposed below are set for low temperature heating. The material 3 to be heated is heated with a heat shielding plate 10 arranged between the material to be heated and the near infrared lamps 1 disposed above as shown in FIG. 2B. The heat shielding plate 10 used in this example has an analogous shape to the material to be heated but slightly smaller than that and a central part of which is cut out to leave an edge portion, where the material to be heated corresponding to the edge portion should not be heated in high temperature.

Thanks to the shielding plate, as shown in FIG. 2C, a low temperature heating portion 23 is heated to a low preset temperature. The reason is that the portion is not heated in high temperature because a high temperature infrared ray 2*a*' radiated from the near infrared lamps 1 disposed above for high temperature heating is shielded by the local heat shielding plate 10 and that the bottom side of the portion is heated by a low temperature infrared ray 2*b* radiated from the near infrared lamps 1 disposed below.

A high temperature heating portion 21 (where no local heat shielding plate 10 is provided) is heated to a high preset temperature by a high temperature infrared ray 2*a* radiated from the infrared lamps 1 disposed above for high temperature heating. In addition, the heating time is shortened because the bottom side of the high temperature heating portion 21 is also heated by the low temperature infrared ray 2*b* radiated from the near infrared lamps 1 disposed below. The high temperature infrared ray 2*a*' is shielded along the shape of the local heat shielding plate 10, and therefore no interference to the low temperature heating portion 23 occurs and it becomes possible to position the boundary from the high temperature heating portion 21 accurately and to make the gradual temperature-changing portion around the boundary small. A shape of the low temperature heating portion 23 can be changed as desired by changing the shape of the local heat shielding plate 10 as desired.

Figure 4B:
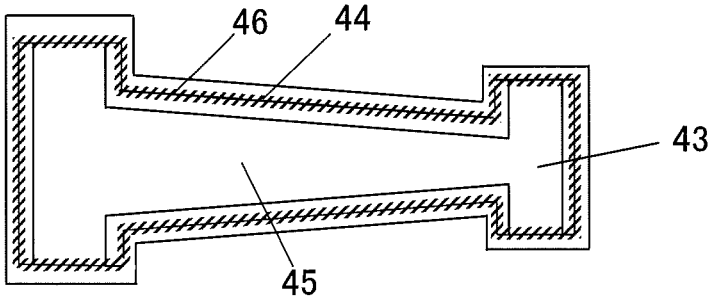

FIG. 4B is an example for applying the method to a part for an automobile. The hot-formed product 43 (B-pillar) shall be cut along the cutting line 46 to produce a shape of a final product after hot forming. By providing the low temperature heating portion 44 around the cutting line 46 only, the hardness becomes low at the portion only after hot-forming and it becomes possible to cut the portion easily with a cutter. According to the present invention, the low temperature heating portion 44 can be set in any shape along the required cutting line 46. In addition, the low temperature heating portion 44 can be positioned accurately so as to reduce an influence on the high temperature heating portion 45 (high-hardness portion).

Example 3

Figure 3A:
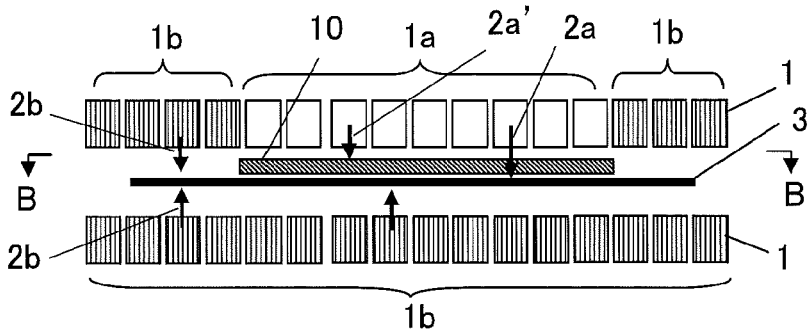
FIGS. 3A to 3C illustrate a sectional view and plan views of further example of a heating device according to the present invention.
Figure 3B:
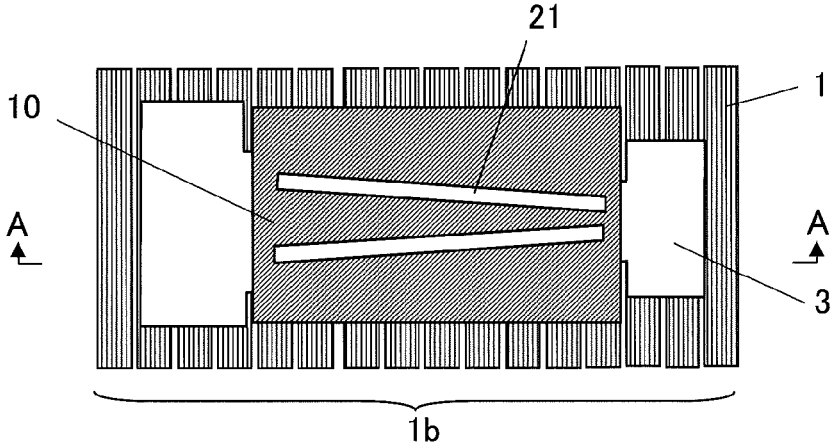
Figure 3C:
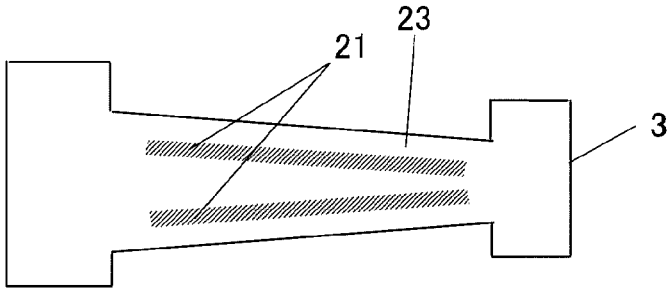

FIGS. 3A to 3C show a further example of a heating device, and a high temperature partial heating method by the device, according to the present invention. FIG. 3A is a sectional figure taken along A-A line in FIG. 3B and FIG. 3B is a plan view taken along B-B line of FIG. 3A. The basic concept is the same as Example 1. A material 3 to be heated is heated by near infrared lamps 1 arranged on both above and below the material. The near infrared lamps 1 disposed above are set partially as a high temperature setting portion 1*a* and partially as a low temperature setting portion 1*b* and the near infrared lamps 1 disposed below are set as a low temperature setting portion 1*b*. By heating the material 3 to be heated with the heat shielding plate 10, parts of which are cut out along a shape of a high temperature heating portion 21, arranged between the material 3 to be heated and the near infrared lamps 1 disposed above as shown in FIG. 3B, the high temperature heating portion 21 only is heated by a high temperature infrared ray 2*a* from the above as shown in FIG. 3C.

A low temperature heating portion 23 around the high temperature heating portion 21 is not heated to a high preset temperature because a high temperature infrared ray 2*a*' from the above is shielded by the heat shielding plate 10 but heated to a low preset temperature by a low temperature infrared ray 2*b* radiated from the near infrared lamps 1 disposed below. Other portion is heated to a low preset temperature by low temperature infrared rays 2*b* from both above and below.

The high temperature infrared ray 2*a*' is shielded along the shape of the heat shielding plate 10, and therefore no interference to the low temperature heating portion 23 occurs and it becomes possible to position the boundary from the high temperature heating portion 21 accurately and to make the gradual temperature-changing portion around the boundary small. A shape of the high temperature heating portion 21 can be changed as desired by changing the shape of the cut out portion of the heat shielding plate 10 as desired.

Figure 4C:
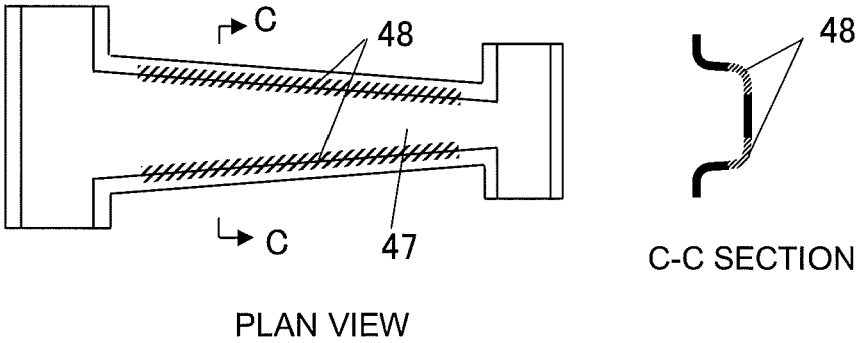

FIG. 4C is an example for applying the method to a part for an automobile. When producing a hot-formed product 47 (B-pillar), as shown in a sectional view taken along a line C-C, it is possible to heat a ridge portion 48 only that requires strength up to the austenitizing temperature or more (about 800 degrees C. or more is preferable) and quench to render the portion only high strength. It becomes possible to heat only a part of a product and quench by hot-forming to render high strength depending on required features of the product in this manner.

Although a sheet plate is used as a material to be heated in examples above explained, a three dimensional material to be heated may be used according to the present invention. That is, a pre-formed product, which is formed in three dimensions to some degree by cold forming or hot forming, can be heated further using the heating device of the present invention. In this case, radiation (electromagnetic wave) generators such as infrared lamps are arranged in three dimensions around a material to be heated and heat shielding plate(s) are arranged in three dimensions between the material to be heated and the electromagnetic wave generators.

A material that can shield infrared rays and difficult to heat such as a ceramics plate or asbestos plate is preferably used as a heat shielding plate. A cooling device may be provided with the heat shielding plate as necessary. A plate a surface of which has a mirror structure such as a gold-reflector for reflecting infrared rays may be also available. In addition, some members of different materials can be combined for making a heat shielding plate.

In examples above explained, a portion other than a high temperature heating portion is heated by infrared radiation at low temperature to increase heating efficiency and to improve shape retentivity after forming. However, only a high temperature heating portion may be heated. Any electromagnetic wave generator other than infrared radiation and a heat shielding plate for shielding the electromagnetic wave may be combined for the present invention. In addition, other heating means may be combined with an electromagnetic wave generator.

Example 4

Figure 5A:
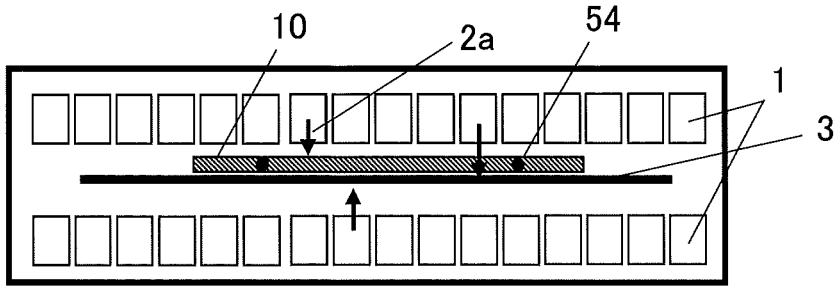
Figure 5B:
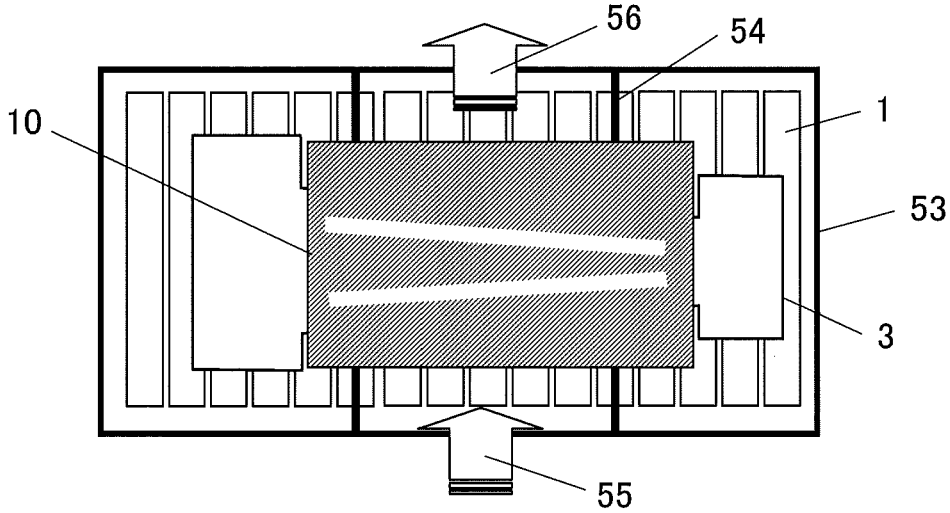

FIGS. 5A and 5B show an example of a heating machine equipped with a heating device according to the present invention for hot-pressing a steel plate as a part of an automobile. FIG. 5A is a section and FIG. 5B is a plan view. A heat shielding plate 10 is held by a stay bar 54 on a frame 53 of the heating machine having near infrared generators (lamp). The heat shielding plate 10 may be arranged in contact with the material 3 to be heated or arranged without contacting with the material. As shown in FIG. 5B, the material 3 to be heated is carried into the machine from the direction 55, heated by the heating device and transferred in the direction 56. A successive heating of multiple steel plates is possible using the single heat shielding plate 10.

The heat shielding plate 10 has a replaceable structure. Thus different heating patterns can be applied by changing the heat shielding plate 10 without changing the near infrared lamps themselves. The heating machine is very versatile because various kinds of materials that can be heated by infrared rays can be heated. In addition, it has a high operability because there is no need for rearrangement of the infrared lamps and it can eliminate the conventional rearrangement works.

It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

EXPLANATION OF SYMBOLS

1 near infrared radiation lamp
1*a*, 1*c* near infrared radiation lamp for setting high temperature heating portion
1*b*, 1*d* near infrared radiation lamp for setting low temperature heating portion
2 near infrared ray
2*a* infrared ray (high temperature infrared ray) radiated (and non-shielded) by lamp for setting high temperature heating portion
2*a*' infrared ray shielded by heat shielding plate
2*b* infrared ray (low temperature infrared ray) radiated by lamp for setting low temperature heating portion
3 material to be heated
5 high temperature heating portion (high-strengthened portion)
6 low temperature heating portion (low-strengthened portion)
7 gradual temperature-changing portion
10 heat shielding plate (plate member)

21 high temperature heating portion
22 temperature boundary region
22*a* temperature boundary
23 low temperature heating portion
39, 43, 47 hot-formed product
42, 45, 48 high temperature heating portion (high-hardened portion)
40, 44 low temperature heating portion (low-hardened portion)
46 cutting line
53 device frame
54 stay bar

The invention claimed is:

1. A heating device for heating a material to be heated by applying an electromagnetic wave to the material, comprising:

a plurality of generators irradiating electromagnetic radiation which are arranged and in which a heating capacity of each of the generators can be controlled; and a plate member(s) which performs at least one of shield, absorb and reflect of the irradiated electromagnetic radiation and has a predetermined pattern contour, wherein said plate member(s) can be placed, at least partially, close to the material to be heated and the generators, wherein the heated material is formed with partial different heating temperatures corresponding to a desirable strength distribution, cooperatively by controlling an output distribution of the plurality of the generators and partially shielding the radiation irradiated toward the material using the plate member(s).

2. The heating device as defined in claim 1, wherein the generators of the electromagnetic radiation are arranged two- or three-dimensionally around the material to be heated and accordingly the plate member(s) is placed in two- or three-dimensionally between the generators placed over one surface of the material to be heated and the one surface of the material to be heated.

3. The heating device as defined in claim 1, wherein the generators are near infrared generators and the plate member(s) is made of material(s) which performs at least one of shield, absorb and reflect of the irradiated near infrared radiation.

4. The heating device as defined in claim 1, wherein the plate member is made of at least one of ceramics, fiber materials that can perform at least one of shield, absorb and reflect of the irradiated radiation or a composite material thereof, and a reflecting mirror.

5. The heating device as defined in claim 1, wherein the plate member(s) is made of at least one component formed in two- or three-dimensionally in conformity with a predetermined heating area of the material to be heated.

6. The heating device as defined in claim 1, wherein the material to be heated is a steel plate or a steel plate product formed in three dimensionally.

7. The heating device as defined in claim 1, comprising:

at least one further radiation generator, which is different from the generator of the electromagnetic wave.

8. The heating device as defined in claim 1, wherein the plate member(s) is supported by a stay bar and placed without contacting with a surface of the material to be heated.

9. The heating device as defined in claim 1, wherein the plate member(s) is placed in contact with a surface of the material to be heated.

10. The heating device as defined in claim 1, wherein the generators are one of middle-infrared generators, far-infrared generators, microwave generators and laser beam generators, and the plate member is made of material(s) which performs at least one of shield, absorb and reflect of the irradiated electromagnetic radiation.

11. A heating method by irradiation of an electromagnetic wave radiation for a material to be heated, wherein a plate member(s) which performs at least one of shield, absorb and reflect of the irradiated electromagnetic radiation and has a predetermined pattern contour is at least partially placed between a plurality of generators of the electromagnetic radiation whose each heating capacity can be controlled and the material to be heated, wherein the heated material is formed with partial different heating temperatures corresponding to a desirable strength distribution, cooperatively by controlling an output distribution of the plurality of the generators and partially shielding the radiation irradiated toward the material using the plate member(s).

12. The heating method as defined in claim 11, wherein the whole of a steel material to be heated is heated at a temperature lower than the austenitizing temperature and at the same time a predetermined area is heated at a temperature higher than the austenitizing temperature.

13. The heating device as defined in claim 1, wherein the generators can be controlled in which the generators irradiate both high and low intensity radiations depending on settings to generate both high and low temperature heating portion on the material.

14. The heating device as defined in claim 1, wherein the material is wholly heated on both sides of the material with a predetermined temperature distribution.

15. The heating device as defined in claim 1, wherein a cooling device is provided with the plate member(s).

16. A heating device for heating a material to be heated by applying an electromagnetic wave to the material, comprising:

a plurality of generators irradiating electromagnetic radiation which are arranged and in which a heating capacity of each of the generators can be independently controlled, and wherein the generators are arranged to generate a high temperature heating portion on at least a portion of the material and a low temperature heating portion on at least another portion of the material; and a plate member(s) which performs at least one of shield, absorb and reflect of the irradiated electromagnetic radiation and has a predetermined pattern contour, wherein said plate member(s) can be placed, at least partially, close to the material to be heated and the generators, wherein the heated material is formed with partial different heating temperatures corresponding to a desirable strength distribution, cooperatively by controlling an output distribution of the plurality of the generators and partially shielding the radiation irradiated toward the material using the plate member(s).

17. The heating device as defined in claim 16, wherein the plurality of generators of the electromagnetic radiation are arranged two- or three-dimensionally around the material to be heated and accordingly the plate member(s) is placed in two- or three-dimensionally between the generators placed over one surface of the material to be heated and the one surface of the material to be heated.

18. The heating device as defined in claim 16, wherein the generators are near infrared generators and the plate member(s) is made of material(s) which performs at least one of shield, absorb and reflect of the irradiated near infrared radiation.

19. The heating device as defined in claim 16, wherein the plate member(s) is made of at least one of ceramics, fiber materials that can perform at least one of shield, absorb and reflect of the irradiated radiation or a composite material thereof, and a reflecting mirror.

20. The heating device as defined in claim 16, wherein each of the plurality of generators is configured to irradiate a high intensity radiation and a low intensity radiation.

21. The heating device as defined in claim 1, wherein the plate member(s) is arranged to shield at least a part of high intensity radiation.

22. The heating device as defined in claim 1, wherein the plurality of generators are controlled and the plate member(s) is arranged, in such a way that only a high temperature heating portion on the material is heated.

23. The heating device as defined in claim 1, wherein the plate member(s) is arranged between a predetermined temperature heating portion on the material and at least one of the plurality of generators.

24. A heating device for heating a material to be heated by applying an electromagnetic wave to the material, comprising:

a plurality of generators irradiating electromagnetic radiation which are arranged and in which a heating capacity of each of the generators can be independently controlled, and wherein the generators are arranged to generate a high temperature heating portion on at least a portion of the material and a low temperature heating portion on at least another portion of the material; and a plate member(s) which performs at least one of shield, absorb and reflect of the irradiated electromagnetic radiation and has a predetermined pattern contour, wherein said plate member(s) can be placed, at least partially between the material to be heated and the generators, wherein the material is heated from both sides thereof;

the plate member(s) is placed on one side of the material; and wherein heating intensity distributors in the both sides are different each other, due to control of the generators and placement of the plate.

* * * * *